US010682861B2

(12) United States Patent
Smith et al.

(10) Patent No.: US 10,682,861 B2
(45) Date of Patent: Jun. 16, 2020

(54) CARTRIDGE AND PRINTER

(71) Applicant: Videojet Technologies Inc., Wood Dale, IL (US)

(72) Inventors: Robert Smith, Thrapston (GB); Salhadin Omer, Cambridge (GB)

(73) Assignee: VIDEOJET TECHNOLOGIES INC., Wood Dale, IL (US)

( * ) Notice: Subject to any disclaimer, the term of this patent is extended or adjusted under 35 U.S.C. 154(b) by 0 days.

(21) Appl. No.: 16/094,480

(22) PCT Filed: Apr. 19, 2017

(86) PCT No.: PCT/GB2017/051095

§ 371 (c)(1),
(2) Date: Oct. 18, 2018

(87) PCT Pub. No.: WO2017/182806

PCT Pub. Date: Oct. 26, 2017

(65) Prior Publication Data

US 2019/0118543 A1 Apr. 25, 2019

(30) Foreign Application Priority Data

Apr. 20, 2016 (GB) ..... 1606899.1

(51) Int. Cl.
*B41J 2/175* (2006.01)

(52) U.S. Cl.
CPC ..... *B41J 2/17553* (2013.01); *B41J 2/17503* (2013.01); *B41J 2/17513* (2013.01)

(58) Field of Classification Search
CPC ..... B41J 2/17553; B41J 2/17556; B41J 2/17559; B41J 2/17503; B41J 2/17513
See application file for complete search history.

(56) References Cited

U.S. PATENT DOCUMENTS 6,290,343 B1 * 9/2001 Lewis ..... B41J 2/175 347/85
6,293,660 B1 9/2001 Kishida et al.
(Continued)

FOREIGN PATENT DOCUMENTS

CA 2274879 A1 1/1994
CA 2404186 A1 3/2003
(Continued)

OTHER PUBLICATIONS

International Search Report with Written Opinion dated Jul. 5, 2017, for corresponding PCT/GB2017/051095.
Search Report for GB1606899.1, dated Oct. 10, 2016.

*Primary Examiner* — Jason S Uhlenhake
(74) *Attorney, Agent, or Firm* — Beusse, Wolter, Sanks & Maire PLLC; Robert L. Wolter

(57) ABSTRACT

A cartridge for storing and dispensing liquid for use with an inkjet printer includes a reservoir for storage of the liquid and an outlet for dispensing the liquid. The reservoir has a reinforcing structure and maintains a predetermined separation. The reinforcing structure separates an internal space of the reservoir into a first and second chamber. The reinforcing structure provides a fluid communication path between the chambers. The reinforcing structure has first and second portions of wall that partially defining the first and second chambers. The reinforcing structure has a wall partially defining the fluid communication path. The first and second portions of the wall have an arcuate profile. The first and second chambers have respective first and second widths. The fluid communication path has a third width which is less than the first or second widths.

27 Claims, 6 Drawing Sheets

(56) References Cited

U.S. PATENT DOCUMENTS

| | | | | |
|---|---|---|---|---|
| 6,332,675 | B1 | 12/2001 | Koitabashi et al. | |
| 2008/0259141 | A1 | 10/2008 | Myers et al. | |
| 2012/0147102 | A1* | 6/2012 | Aoki | B41J 2/17513 347/86 |
| 2012/0200619 | A1* | 8/2012 | Bibl | B41J 2/17513 347/6 |
| 2016/0101627 | A1* | 4/2016 | Pagnon | B41J 2/17506 347/86 |

FOREIGN PATENT DOCUMENTS

| | | | |
|---|---|---|---|
| CN | 203623147 | U | 6/2014 |
| EP | 0822085 | A2 | 2/1998 |
| EP | 1602489 | A2 | 12/2005 |
| EP | 2522514 | A2 | 11/2012 |
| GB | 2315462 | A | 2/1998 |
| WO | 2013060247 | A1 | 5/2013 |

* cited by examiner

CARTRIDGE AND PRINTER

CROSS REFERENCE TO RELATED APPLICATIONS

This application is the US National Stage of International Application No. PCT/GB2017/051095 filed Apr. 19, 2017, and claims the benefit thereof. The International Application claims the benefit of United Kingdom Application No. 1606899.1 filed Apr. 20, 2016. All of the applications are incorporated by reference herein in their entirety.

The present invention relates to inkjet printing and more particularly to a cartridge for storing and dispensing liquid for use with an inkjet printer, such as a continuous inkjet printer, and an inkjet printer including the cartridge.

In inkjet printing systems the print is made up of individual droplets of ink generated at a nozzle and propelled towards a substrate. There are two principal systems: drop on demand where ink droplets for printing are generated as and when required; and continuous inkjet printing in which droplets are continuously produced and only selected ones are directed towards the substrate, the others being recirculated to an ink supply.

Continuous inkjet printers supply pressurised ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous inkjet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The system includes a main pump that draws the ink from a tank of the ink supply system via a filter and delivers it under pressure to the print head. As ink is consumed the tank is refilled as necessary from a replaceable ink cartridge that is releasably connected to the tank by a supply conduit. The ink is fed from the tank via a flexible delivery conduit to the print head. The unused ink drops captured by the gutter are recirculated to the tank via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. In order to compensate for this, "make-up" solvent is added to the ink as required from a replaceable solvent cartridge so as to maintain the ink viscosity within desired limits. This solvent may also be used for flushing components of the print head, such as the nozzle and the gutter, in a cleaning cycle.

Therefore, a typical continuous inkjet printer has both a replaceable ink cartridge and a replaceable solvent cartridge. In this description, both ink cartridge and solvent cartridge are referred to as cartridges. Suitably, each cartridge has a reservoir for storage of liquid, such as ink or solvent, and an outlet through which the respective liquid is dispensed. The outlet for each cartridge is connected, via fluid-tight means, to a pumping system for withdrawing liquid from the reservoir of the cartridge to the tank of the ink supply system, so that the tank can be intermittently topped-up by drawing ink and/or solvent from the cartridges as required. To ensure the cartridges are brought into correct registration with supply conduits, the cartridges are typically connected to the ink supply system via a docking station comprising a cartridge holder. The ink supply system may comprise a fluid connector for engaging the outlet of each cartridge so as to allow liquid to flow from the cartridges into the ink supply system. The ink supply system may also comprise an electrical contact arranged to read information from and/or write information to an electronic data storage device associated with the respective cartridge. When the cartridges are correctly docked, fluid communication with the outlet of each cartridge and electrical communication with the electronic data storage device associated with each cartridge are both ensured.

In typical inkjet printing processes, ink is consumed in a number of ways. Besides an amount of ink used for actual printing on the substrate, ink may, for example, also be used to maintain the health of the print head, to prepare the inkjet printer for use in start-up procedures, to service the print head, and to prevent clogging. These additional consumptions of ink can be considerable. For continuous inkjet printers, apart from the consumption of ink, a large amount of solvent may also be required to be supplied from the solvent cartridge to top up the ink. Such topping up may, for example, be required to compensate for solvent which evaporates during the ink recirculation process. Solvent may also be used in other ways, for example, to perform cleaning of the print head and the like.

It will be appreciated from the above that it would be desirable to have high capacity cartridges for storing and dispensing high volumes of liquid, such that run time of an inkjet printer can be extended between changes of the cartridges. In this way, productivity of the inkjet printer, in particular the continuous inkjet printer, can be improved, and maintenance costs associated with changing the cartridges can be reduced.

It is an object of the present invention, among others, to provide an improved or an alternative high capacity cartridge for use with an inkjet printer, such as a continuous inkjet printer.

According to a first aspect of the invention there is provided a cartridge for storing and dispensing liquid for use with an inkjet printer, the cartridge comprising: a reservoir having at least one wall enclosing an internal space for storage of the liquid; and an outlet for dispensing the liquid; the reservoir comprising: a reinforcing structure extending from a first part of the at least one wall and from a second part of the at least one wall, the reinforcing structure being adapted to maintain a predetermined separation between the first and second parts of the at least one wall, the first and second parts of the at least one wall being within a boundary of the at least one wall.

By maintaining the predetermined separation between the first and second parts of the at least one wall, it is meant that the separation between the first and second parts is controlled and restricted by the reinforcing structure, for example to meet a predetermined criterion. The predetermined criterion may, for example, be a predetermined value of the separation, a predetermined range of the separation, or the like. The reinforcing structure may be adapted to maintain the predetermined separation in a first direction.

The use of the reinforcing structure within the cartridge is advantageous in that the reinforcing structure directly controls the separation between the first and second parts, thereby controlling an outer profile of the cartridge. The inclusion of a reinforcing structure which is arranged in this way allows the reservoir to have an increased liquid capacity while reducing the risk that the reservoir will experience significant distortion, such as bulging, or ballooning, when filled with liquid.

The reinforcing structure may be adapted to separate the internal space of the reservoir into a first chamber and a second chamber. The reinforcing structure may be further adapted to provide at least one fluid communication path between the first and second chambers.

The reinforcing structure and the first and second chambers may be arranged along a second direction perpendicular to the first direction.

The reinforcing structure may comprise first and second portions of wall, the first and second portions of wall partially defining the first and second chambers, respectively. That is, the first portion of wall may partially define the first chamber, and the second portion of wall may partially define the second chamber.

The reinforcing structure may further comprise a wall partially defining the at least one fluid communication path. The first and second portions of wall partially defining the first and second chambers, and the wall partially defining the at least one fluid communication path, may each comprise portions of said at least one wall enclosing the internal space.

The first and second portions of wall may each define a smooth profile. The wall partially defining the at least one fluid communication path may define a smooth profile. One or more of the first and second portions of wall and the wall partially defining the at least one fluid communication path may define an arcuate profile.

The first and second chambers may have respective first and second widths in a third direction perpendicular to each of said first and second directions. Said at least one fluid communication path may have a third width, in said third direction. Said third width may be less than said first and/or second widths.

The provision of a fluid communication path having a width less than the first and second widths provides a convenient means for fluid to pass between the first and second chambers, while also providing structural reinforcement to the reservoir. In particular, the fluid communication path may form a narrow "waist" of the reservoir which reduces the extent to which the walls of the reservoir can bulge under pressure, while the smooth (or rounded) profile of the walls allow stress concentrations to be reduced.

The term "smooth profile" is intended to mean that there are no abrupt changes in direction in the profile of the wall, allowing tensile stress (which may, for example, be caused as a result of a pressure within the reservoir) to be distributed more evenly throughout the wall, rather than leading to stress concentrations (as may be experienced with abrupt changes in direction). Such stress concentrations could result in localised failure of the integrity of the reservoir wall (e.g. splitting) if they exceed an acceptable level.

By arranging the first and second portions of the walls partially defining the first and second chambers to define a smooth profile, stress is distributed throughout the smooth profile of the first and second portions, and stress concentrations around the reinforcing structure can be reduced. Accordingly, the cartridge may become more structurally durable. The arrangement of the smooth profile may advantageously allow the cartridge to meet regulation requirements for transportation of hazardous goods (such as, for example, the need to withstand a predetermined pressure).

The reinforcing structure may provide a path between a first plane substantially parallel with said first part of the at least one wall and a second plane substantially parallel with said second part of the at least one wall, said path being unobstructed by any wall of said reservoir.

The term "unobstructed path" is intended to mean that it is possible to pass, along at least one path, from said first plane to said second plane, through a part of the reinforcing structure, without encountering any wall of the reservoir. Of course, it is possible that the path may be obstructed by alternative materials, or portions of the same material as that which forms the reservoir walls, but which does not form a functional part of the reservoir wall (i.e. which parts do not prevent liquid contained within the internal space of the reservoir from escaping).

In the expression "a wall partially defining the at least one fluid communication path", the term "partially defining" is intended to mean that the at least one fluid communication path is surrounded partially by the wall. Likewise, the expression "walls partially defining the first and second chambers" is intended to mean that the first and second chambers are surrounded partially by the respective walls.

The reinforcing structure may comprise a central region which is isolated from the internal space of the cartridge. The central region may be disposed generally centrally to the cartridge in at least one of the first, second and third directions. By isolated, it is meant that the central region is not in fluid communication with the internal space of the cartridge. The central region may be separate from the at least one fluid communication path.

The isolation between the central region and the internal space of the cartridge may be provided by the first and second portions of wall partially defining the first and second chambers, and the wall partially defining the at least one fluid communication path.

The central region may be directly accessible from the exterior of the cartridge. That is, the central region may be exposed to the exterior of the cartridge.

The central region may be further separate from the at least one fluid communication path. It will be appreciated that the expression of "separate from" is intended to mean that the central region and the at least one fluid communication path are two distinct elements and exist independently from each other. However, it is not intended that the expression "separate from" be interpreted to mean that walls defining the central region and the fluid communication path cannot be formed from the same material. Indeed, such walls may be formed as one contiguous piece. The separation between the central region and the at least one fluid communication path may be made by a wall partially defining the at least one fluid communication path. The central region may be isolated from the liquid stored in the reservoir.

The reinforcing structure may comprise an aperture surrounded by walls partially defining the first and second chambers and a wall partially defining the at least one fluid communication path.

The reinforcing structure may comprise an aperture at least partially surrounded by said first and second portions of wall partially defining the first and second chambers and said wall partially defining the at least one fluid communication path.

The aperture is particularly advantageous for reducing the manufacturing complexity of the cartridge and allows the cartridge to be easily made by rotational or blow moulding.

The aperture may extend through the reservoir in the first direction.

The cartridge may comprise first and second fluid communication paths, wherein the aperture is surrounded by said first and second portions of wall partially defining the first and second chambers, and walls partially defining each of said first and second fluid communication paths.

The boundary of the at least one wall may be defined by, for example, a perimeter of the at least one wall. By requiring the first and second parts to be within the boundary of the at least one wall, it is meant that the first and second parts are surrounded by the boundary and do not protrude beyond the boundary. While the peripheral edges and/or end points of the first and second parts may lie on the boundary of the at least one wall, the first and the second parts shall each have at least a portion spaced apart from the boundary.

The first and second parts may be located at opposite sides of the reservoir across the internal space. The reinforcing structure may extend between the first and second parts through the internal space of the reservoir.

The at least one wall of the reservoir may comprise first and second opposed face walls, the first face wall having a first boundary defined by its perimeter, and the second face wall having a second boundary defined by its perimeter.

The first part may be comprised in the first face wall and the second part may be comprised in the second face wall. The first part may be within the first boundary and the second part may be within the second boundary.

The first and second opposed face walls may be substantially parallel, or may suitably form an angle with respect to each other.

By requiring the first part to be within the first boundary, it is meant that the first part is surrounded by the first boundary and does not protrude beyond the first boundary. While the peripheral edges and/or end points of the first part may lie on the first boundary, the first part shall have at least a portion spaced apart from the first boundary. Similar meaning may be applied to the expression of the second part within the second boundary.

The reinforcing structure may be adapted to maintain a separation between the first and second parts below a predetermined upper limit.

By maintaining the separation below the predetermined upper limit it is meant that the separation between respective portions of the walls is controlled so as to be less than the predetermined upper limit.

The reinforcing structure may be adapted to maintain a separation between the first face wall and second face wall below a predetermined upper limit. For example, the reinforcing structure may be arranged to restrict movement of the first and second face walls so as to prevent the reservoir from being distorted to such an extent that the separation between the face walls exceeds the predetermined upper limit.

The reinforcing structure may be adapted to maintain the separation between the first and second parts above a predetermined lower limit.

The reinforcing structure may be adapted to maintain the separation between the first and second parts below a first predetermined upper limit and the separation between parts of the first and second face walls other than the first and second parts below a second predetermined upper limit. The second predetermined upper limit may be greater than the first predetermined upper limit.

The reinforcing structure may extend inwardly from the first part and extend inwardly from the second part. Alternatively, the reinforcing structure may extend outwardly from the first part and extend outwardly from the second part. It will be appreciated that the expression of "inwardly" is intended to refer to a direction from the exterior of the reservoir to the internal space of the reservoir. Conversely, "outwardly" is intended to refer to a direction from the internal space of the reservoir to the exterior of the reservoir.

The reinforcing structure may extend between the first part and the second part. This allows the reinforcing structure to act as a link between the first part and the second part, thereby directly controlling of the separation therebetween.

The reservoir may further comprise one or more perimeter walls connecting the respective boundaries of the first and second face walls so as to define said internal space.

The reinforcing structure may be separate from the at least one wall. The reinforcing structure may be separate from said one or more perimeter walls. It will be appreciated that the expression of "separate from" is intended to mean that the reinforcing structure and the at least one wall (or the one or more perimeter walls), are two distinct elements and exist independently from each other.

An area of each face wall may be greater than that of any perimeter wall of the reservoir.

The reinforcing structure may comprise a solid portion surrounded by and extending between walls partially defining the first and second chambers and a wall partially defining the at least one fluid communication path.

A wall partially defining the at least one fluid communication path may be recessed from a plane defined by the first or second face wall. This is advantageous for enhancing the rigidity of the at least one fluid communication path and ensures that the path will not easily collapse.

A cross-sectional size of the at least one fluid communication path may increase from a mid-point between the first and second chambers towards the first and/or second chamber. This is particularly advantageous in that it forms a funnel shape at each axial end of the fluid communication path, thereby facilitating fluid communication between the first and second chambers.

A cross-section of the at least one fluid communication path may be substantially circular. That is, when viewed along the second direction, the cross-section of the at least one fluid communication path may be substantially circular.

The at least one fluid communication path may be partially defined by a portion of the one or more perimeter walls. This ensures the fluid communication between the first and second chambers. In particular, the perimeter walls may serve to reinforce the at least one fluid communication path, resulting in the path being less susceptible to deformation.

The cartridge may be adapted to prevent air from entering the internal space of the reservoir from outside the cartridge as the liquid is dispensed from the outlet. The cartridge may be further adapted such that at least a portion of the reservoir deforms as the liquid is dispensed.

The liquid stored in the cartridge may comprise ink or solvent. The ink or solvent may comprise an organic solvent selected from $C_1$-$C_4$ alcohols, $C_4$-$C_8$ ethers, $C_3$-$C_6$ ketones, $C_3$-$C_6$ esters, and mixtures thereof.

A total volume of the cartridge may be at least 500 millilitres. For example, a total volume of the cartridge may be around 600 millilitres, 700 millilitres, 750 millilitres, 800 millilitres, or 900 millilitres. Preferably, the total volume of the cartridge may be at least 1000 millilitres.

The cartridge may be for use with a continuous inkjet printer.

The reservoir may be a single-piece item. The reservoir may be formed by blow moulding.

According to a second aspect of the invention there is provided an inkjet printer comprising the cartridge of the first aspect.

The inkjet printer may be a continuous inkjet printer.

According to a third aspect of the invention, there is provided a cartridge assembly for use with an inkjet printer. The cartridge assembly comprises a cartridge according to the first aspect of the invention and a housing for the cartridge. The housing may be referred to as a shell, a casing, or a shell casing. The housing may be arranged to substantially enclose the cartridge.

The cartridge assembly may further comprise an electronic data storage device storing data identifying the cartridge and/or the liquid contained in the cartridge.

Features described above with reference to the first aspect of the invention may be combined with the second and third aspects of the invention.

Embodiments of the invention will now be described, by way of example only, with reference to the accompanying drawings in which.

A first embodiment of a cartridge 1 is schematically shown in FIGS. 1 to 4 and described in more detail below.

Figure 1:
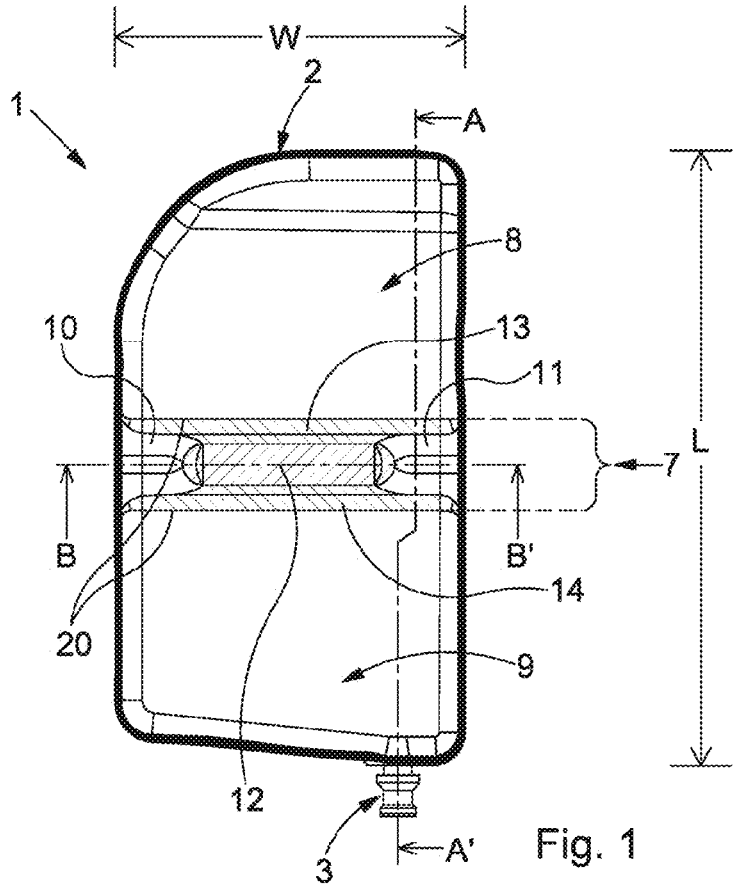
FIG. 1 is a front view of a cartridge according to a first embodiment of the invention.

As illustrated in FIG. 1, the cartridge 1 includes a reservoir 2 which encloses an internal space for storage of liquid, and an outlet 3 for dispensing the liquid from the reservoir 2 to, for example, an ink supply system of an inkjet printer. The outlet 3 may be provided with a fluid-tight seal or valve (not shown) which forms a fluid-tight engagement with a fluid connector of the ink supply system. The liquid stored in the reservoir 2 may, for example, include ink or solvent, or any other suitable liquid for use with the inkjet printer. In particular embodiments, the ink and/or solvent may include an organic solvent selected from $C_1$-$C_4$ alcohols, $C_4$-$C_8$ ethers, $C_3$-$C_6$ ketones, $C_3$-$C_6$ esters, and mixtures thereof. Examples of $C_1$-$C_4$ alcohols include methanol, ethanol, 1-propanol, and 2-propanol. Examples of $C_4$-$C_8$ ethers include diethyl ether, dipropyl ether, dibutyl ether and tetrahydrofuran. Examples of $C_3$-$C_6$ ketones include acetone, methyl ethyl ketone and cyclohexanone. Examples of $C_3$-$C_6$ esters include methyl acetate, ethyl acetate and n-butyl acetate. The reservoir 2 is particularly suitable for storing liquids that include aggressive organic solvents such as alcohols and ketones, particularly methanol, ethanol, acetone, and methyl ethyl ketone.

In the illustrated embodiment, the reservoir 2 has a box shape, with a length L in a second direction, and a width W in a third direction (see FIG. 1). The internal space of the reservoir 2 is defined by a first face wall 4 (see FIG. 3), a second face wall 5 (see FIG. 3), and perimeter walls 6 (see FIG. 2). The first and second face walls 4, 5 are on opposite sides of the reservoir 2. The first face wall 4 comprises a first boundary as shown in the emboldened line (virtual) in FIG. 1. The second face wall 5 comprises a second boundary (not shown) which is of a similar shape to the first boundary of wall 4. The perimeter walls 6 connect the first and second boundaries of walls 4, 5. Suitably, the perimeter walls have a width defined by a separation between the first and second boundaries, in a first direction. An area of each face wall 4, 5 is greater than that of the perimeter walls 6 of the reservoir 2. The width of the perimeter walls 6 is less than the length L of the reservoir 2 in a second direction perpendicular to the first direction. The width of the perimeter walls 6 is less than the width W of the reservoir 2 in a third direction perpendicular to the first and second directions. For example, the width of the perimeter walls 6 may be less than 50% of the width W. The two face walls 4, 5 are substantially parallel to each other as illustrated in FIG. 3. However, it will be appreciated that the face walls 4, 5 may also be arranged to form an angle therebetween. Similarly, the relative dimensions of the face and perimeter walls may be varied.

The walls 4, 5, 6 of the reservoir 2 may be considered to be elastically deformable. That is, if a pressure in the internal space of the reservoir 2 changes with respect to the ambient pressure, then at least one of the deformable walls 4, 5, 6 will deform temporarily to compensate for the pressure difference between the pressure in the internal space and the ambient pressure. Moreover, it will be appreciated that as liquid is withdrawn from the internal space within the reservoir 2 (e.g. by the application of negative pressure at the outlet), the walls of the reservoir will deform so as to accommodate the new (reduced) internal volume. Once the negative pressure at the outlet is removed, assuming that the reservoir is sealed such that air cannot enter the reservoir, the new (reduced) internal volume will be maintained. During this process of liquid extraction energy will be stored within the walls by virtue of their elastic deformation, resulting in a gradually increasing minimum (negative) pressure being required to extract liquid from the cartridge. This characteristic may be used to generate an estimate of the volume of liquid remaining within the reservoir. That is, the minimum (negative) pressure being required to extract liquid from the cartridge increases substantially monotonically with the volume of liquid remaining within the reservoir, and can thus be used to determine the volume of liquid remaining within the reservoir. Such a process is described in more detail in European patent number 2,195,168.

To control a separation S (see FIG. 3) between the two opposed face walls 4, 5 and to reduce deformation of the reservoir 2 (as explained in more detail below), a reinforcing structure 7 is provided. As shown in FIGS. 1 and 3, the reinforcing structure 7 is located centrally along the length L of the reservoir, forming a waist portion of the reservoir 2. The reinforcing structure 7 preferably does not protrude beyond the outer boundaries of the reservoir 2 as defined by the face walls 4, 5 and the perimeter walls 6. As shown in FIGS. 1 and 3, the reinforcing structure 7 extends from a part 20 of the first face wall 4. The part 20 is considered to be generally within the first boundary of the first face wall 4, as clearly shown in FIG. 1. In particular, the part 20 is surrounded by the first boundary and does not protrude beyond the first boundary. While the left and right end points of the part 20 may lie on the first boundary, all other portions of the part 20 are spaced apart from the first boundary. Likewise, the reinforcing structure 7 also extends from a part 21 of the second face wall 5 (see FIGS. 2 and 3). The part 21 is considered to be generally within the second boundary of the second face wall 5.

Figure 2:
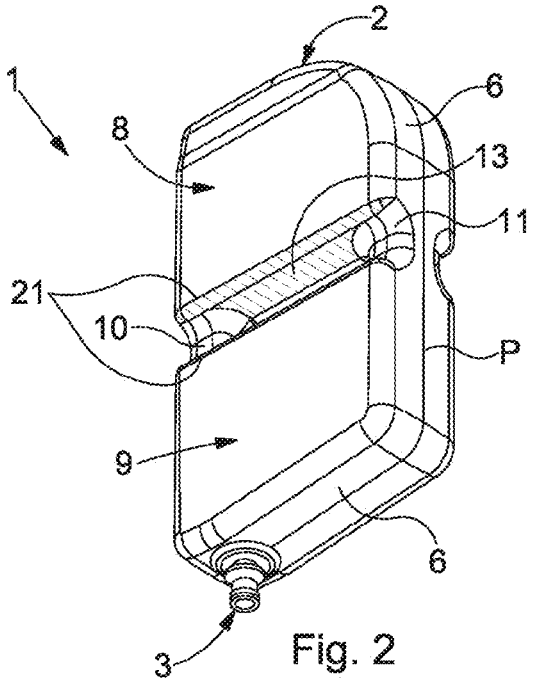
FIG. 2 is a perspective view of the cartridge shown in FIG. 1.
Figure 3:
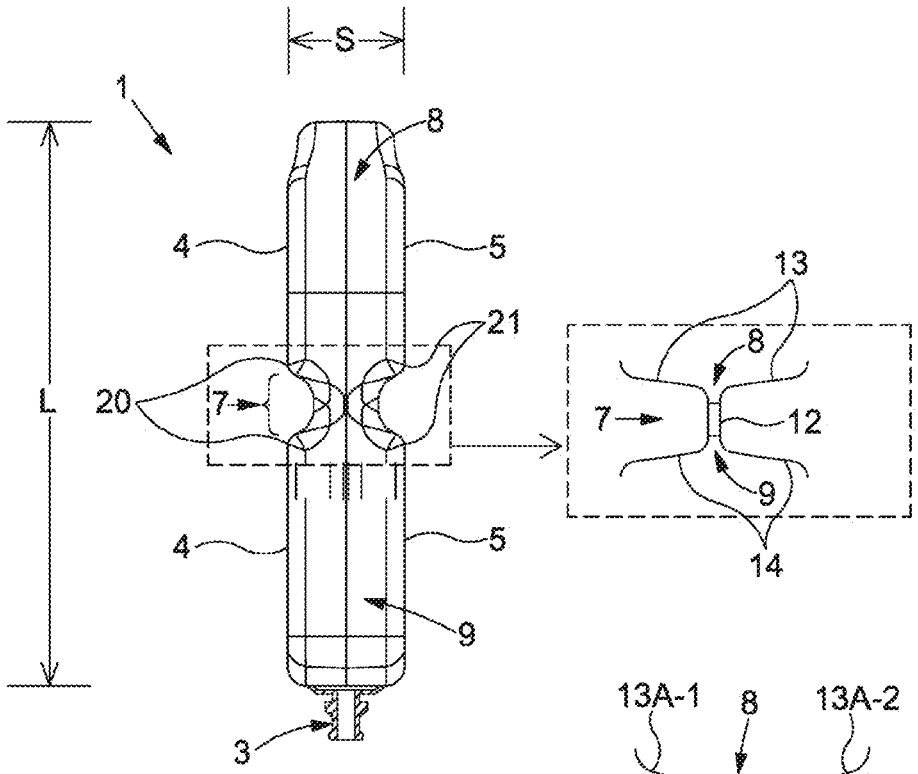
FIG. 3 is a cross-sectional side view of the cartridge shown in FIG. 1 when the cartridge is cut along line A-A'.

As shown in FIGS. 1, 2 and 3, the reinforcing structure 7 separates the internal space of the reservoir 2 into a first chamber 8 and a second chamber 9. As further shown in FIGS. 1 and 4, the reinforcing structure 7 provides fluid communication paths 10, 11 between the chambers 8, 9. As can be seen from FIGS. 2 and 4, the fluid communication path 11 is surrounded by a right-end portion 15 of the reinforcing structure 7 and a portion 16 of the perimeter wall 6. That is, the right-end portion 15 of the reinforcing structure 7 and the portion 16 of the perimeter wall 6 together define the fluid communication path 11. Similarly, the fluid communication path 10 is surrounded by a left-end portion 17 of the reinforcing structure 7 and a portion 18 of the perimeter wall 6, which together define the fluid communication path 10.

Figure 4:
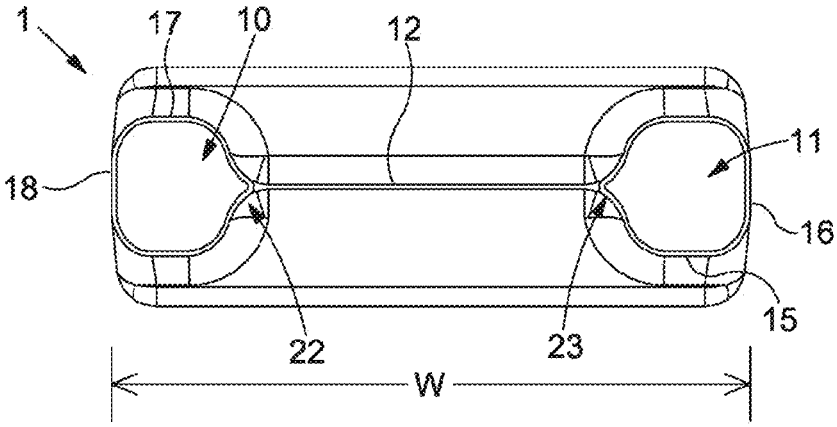
FIG. 4 is a cross-sectional view of the cartridge shown in FIG. 1 when the cartridge is cut along line B-B' in FIG. 1.

As further shown in FIG. 4, a cross section of the fluid communication paths 10, 11 is substantially square with rounded corners and a respective beak portion 22, 23. The beak portion 22 is formed in the left-end portion 17 of the reinforcing structure 7. The beak portion 23 is formed in the right-end portion 15 of the reinforcing structure 7. Since the fluid communication paths 10, 11 are surrounded partially by the respective beak portions 22, 23, it can be said that the beak portions 22, 23 partially define the respective fluid communication paths 10, 11. A tip of each of the beak portions 22, 23 is connected to a centre portion 12 of the reinforcing structure 7. The beak portions 22, 23 each have two walls that gradually curve away from each other in a generally symmetrical fashion. In this way, continuous and smooth connections are formed between the centre portion 12 and each of the left-end portion 17 and the right-end portion 15. This is advantageous in enhancing the structural robustness of the reinforcing structure 7, as it serves to relieve the stress at the interfaces between the centre portion 12 and both of the left-end portion 17 and the right-end portion 15.

The centre portion 12 of the reinforcing structure 7 has a substantially rectangular shape with rounded corners, as shown in FIG. 1. The rounded corners are helpful to make the fluid communication paths 10, 11 more robust, such that the fluid communication paths 10, 11 do not easily collapse. The centre portion 12 is in the form of a solid sheet. The centre portion 12 does not therefore provide any fluid communication path between the first and second chambers 8, 9, as seen in the cross-sectional view in FIG. 4. As described above, the centre portion 12 extends between the beak portion 22 of the left-end portion 17 and the beak portion 23 of the right-end portion 15 along the width W of the reservoir 2 (see FIGS. 1 and 4).

As shown in FIGS. 1, 2 and 3, the reinforcing structure 7 further defines a bottom wall 13 of the first chamber 8, and an upper wall 14 of the second chamber 9. The bottom wall 13 and the upper wall 14 each extend between the first face wall 4 and the second face wall 5 of the reservoir 2, and are connected with each other by the centre portion 12 of the reinforcing structure 7. As seen most clearly in the inset of FIG. 3, the combination of the bottom wall 13, the upper wall 14 and the centre portion 12 of the reinforcing structure 7 form a X-shaped "cross bracing" between the face walls 4 and 5. The "cross bracing" effectively reinforces the face walls 4, 5 and supports the face walls 4, 5 against compression and tension forces applied thereto, thereby serving to maintain the separation S between the two face walls 4, 5 between predetermined limits. The predetermined limits may include a predetermined upper limit and a predetermined lower limit.

For a conventional cartridge for use with an inkjet printer, if a size of the conventional cartridge is increased to achieve a high volume, it has been realized that the reservoir of the cartridge, which is often made from thermoplastic materials, may deform when filled with liquid. For example, the separation S between two opposed face walls of the reservoir tends to increase due to the weight and fluidity of the liquid contained therein, causing the reservoir to bulge. Additionally, certain organic solvents (such as acetone) which may be contained in the ink or solvent cartridge are volatile. The volatile solvents tend to cause the internal vapour pressure within the reservoir to increase when the temperature within the reservoir increases, if the cartridge is of an air-sealed type. Such an increased internal vapour pressure subsequently has a tendency to cause the reservoir to expand, particularly under high temperature storage or operational conditions.

It will be appreciated that this problem exists for reservoirs of any volume. However, a high-volume reservoir, having a large surface area upon which the internal vapour pressure can act, tends to experience more severe deformation than a reservoir having a lower volume. In an extreme scenario, a high-volume reservoir containing volatile solvent may balloon up so as to have a sphere-like shape under high temperature conditions. The use of a reinforcing structure as described above (and below) can prevent, or at least reduce, such severe deformation.

Furthermore, where an inkjet printer uses cartridges that contain volatile solvents, the internal temperature of the inkjet printer is usually controlled, for example, so as to be below the boiling points of the volatile solvents. For example, an inkjet printer which is rated to operate in an environment with a temperature of up to 50° C. may, for example, have an internal temperature (i.e. a temperature within the printer housing) which is permitted to be up to around 57 or 58° C. On the other hand, an inkjet printer which is rated to operate in an environment with a temperature of up to 45° C. may, for example, have an internal temperature (i.e. a temperature within the printer housing) which is permitted to be up to around 50° C. As such, by providing structural reinforcement to an ink or solvent cartridge, it may be possible to increase the range of operating conditions in which such a cartridge (and thus a printer in which the cartridge is installed) can be used.

Such bulging or ballooning deformation of the reservoir may cause difficulties in handling the cartridge, such as assembling the cartridge into a shell casing (which is described in more detail below) and/or fitting the cartridge into a particular space provided by a cartridge holder, removing a particular cartridge from the shell casing and/or the cartridge holder, and/or connecting the cartridges to both the fluid connectors and the electrical contacts of the ink supply system. It may require a significant effort and time for a maintenance worker to change cartridges in an inkjet printer and to connect the cartridges with the ink supply system. The bulging deformation of the reservoir may also reduce the mechanical strength of the walls of the reservoir or damage the reservoir if any wall cannot sustain the deformation. In the case that the cartridge is assembled with the shell casing to form a cartridge assembly, the bulging deformation of the cartridge may cause strain in the casing and may even damage the casing.

The reinforcing structure 7 effectively reduces or even prevents the bulging deformation of the reservoir 2, and thus allows the reservoir 2 to have a high capacity. In particular, the "cross bracing" formed by the reinforcing structure 7 prevents the separation S between the face walls 4, 5 from exceeding a predetermined upper limit. Therefore, the extent of distortion or deformation, such as bulging or ballooning, experienced by the reservoir 2 when filled with a high volume of liquid is reduced.

It will be appreciated that the structure of existing cartridges (e.g. which may have perimeter walls connecting boundaries of the two opposed face walls) may restrict the movement of the face walls to a certain extent. However, such an effect may be limited to the peripheral regions of the face walls which are immediately adjacent to any such perimeter walls, especially the peripheral regions of the face walls which are immediately adjacent to two adjoining perimeter walls (e.g. at a corner). As the cartridge size is increased, for example, to achieve a high volume of internal space, the effect of the perimeter walls will be reduced on regions of the face walls which are distant from the perimeter walls. The use of the reinforcing structure in addition to any perimeter wall thus allows increased liquid capacity while reducing the risk that the reservoir will experience significant distortion. Additionally, virtually all prior art cartridges in the thermal inkjet (TIJ) printer use water-based solvents which generally do not have the same 'bulging' issues described above.

It will be appreciated that, in normal use, parts of the face walls 4, 5 of the reservoir may experience some deformation in the inward direction. In particular, where an air-tight cartridge is emptied of substantially all of the liquid contained therein (without any air being allowed to replace the removed liquid) it is inevitable that the reservoir will deform to accommodate the reduced internal volume. As such, the walls 4, 5 of the reservoir will deform inwards. However, the presence of the reinforcing structure 7 serves to reinforce parts of the walls 4, 5, ensuring that the reservoir does not collapse completely.

More importantly, it will be appreciated that when filled with liquid, the walls 4, 5, of the reservoir will be forced apart by the presence of the liquid. It will further be appreciated that there may be some deformation of the reservoir in the outward direction. However, as mentioned above, the presence of the reinforcing structure 7 serves to reinforce parts of the walls 4, 5, ensuring that the reservoir does not expand beyond a predetermined amount. It will further be appreciated that while parts of the walls 4, 5 which are immediately connected to the reinforcing structure 7 are maintained close to a nominal separation defined by the original manufactured size of the reinforcing structure 7, parts of the walls 4, 5, which are further from the reinforcing structure 7 are permitted to expand to a separation which is greater than the nominal separation. However, the extent of that expansion is restricted by the operation of the reinforcing structure 7.

It will be appreciated that the profile of the "cross bracing" as described above with reference to FIGS. 1 to 4 can be suitably adjusted to obtain various levels of reinforcing effect, so as to maintain the separation S between predetermined limits as required. This can be achieved by, for example, adjusting a cross-sectional curvature of the bottom wall 13 and the upper wall 14, and/or a cross-sectional dimension of the centre portion 12.

Further, the reservoir 2 may include more than one reinforcing structure 7, to obtain higher levels of reinforcing effect between the two face walls 4, 5.

It will also be appreciated that the predetermined limits as required can be appropriately determined on a case-by-case basis. Each inkjet printer normally has a maximum permitted separation for the separation between the face walls 4, 5. The maximum permitted separation may be defined, for example, based upon a particular dimension of a shell casing for enclosing the cartridge, a particular space allocated to the cartridge in a cartridge holder of the printer, and/or arrangements of the fluid connectors and the electrical contacts in an ink supply system of the printer (amongst other requirements). The predetermined upper limit for the separation S between the face walls 4, 5 is generally below the maximum permitted separation.

It will be appreciated that as the reinforcing structure 7 extends between the part 20 of the first face wall 4 and the part 21 of the second face wall 5, the separation between the parts 20, 21 is directly limited by the reinforcing structure 7. That is, the separation between the parts 20, 21 is maintained below a predetermined limit which is approximately equal to the nominal separation defined by the original manufactured size of the reinforcing structure 7.

However, as explained in more detail above, the reinforcing effect provided by the reinforcing structure 7 may decrease on regions of the walls 4, 5 which are distant from the parts 20, 21. As such, while the reinforcing structure 7 may be arranged to maintain the separation between the parts 20, 21 below a first predetermined limit, the reinforcing structure 7 may also be arranged to maintain a separation between the parts of the walls 4, 5 other than those parts 20, 21 below a second predetermined limit, which is greater than the first predetermined limit. Moreover, in order to maintain the separation between any part of the face walls 4, 5 to be below a maximum permitted separation permitted by the respective inkjet printer, the separation between the parts 20, 21 may be maintained to be below a predetermined limit which is smaller than the maximum permitted separation.

The lower limit for the separation S may be designed with more freedom. For example, at parts of the face walls 4, 5 that are far away from the reinforcing structure 7, the lower limit for the separation between those parts of the face walls may be zero (i.e. the opposing face walls may come into contact with one another). On the other hand, at parts of the face walls that are immediately connected to the reinforcing structure 7, the lower limit for the separation between those parts may be a proportion (for example, but not limited to, 80%) of the nominal separation.

Figure 5:
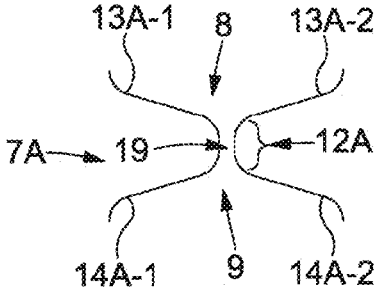
FIG. 5 is a cross-sectional side view of part of the cartridge shown in FIG. 1 when the cartridge is cut along line A-A', according to an alternative first embodiment of the invention.

It will further be appreciated that the bottom wall 13, the upper wall 14 and the centre portion 12 of the reinforcing structure 7 may be further modified, for example, as illustrated in FIG. 5. FIG. 5 shows an alternative arrangement to that of FIG. 3, and shows a cross-sectional side view of part of the cartridge 1 shown in FIG. 1 when the cartridge 1 is cut along line A-A'. It is noted that FIGS. 1 and 2 are still applicable to the arrangement shown in FIG. 5. However, FIG. 4 is only associated with FIG. 3 and is not applicable to the embodiment shown in FIG. 5.

More particularly, a reinforcing structure 7A is shown in FIG. 5. The centre portion 12A of the reinforcing structure 7A includes two plates which define a narrow slit 19. The narrow slit 19 allows fluid communication between the first and second chambers 8, 9. Further, the bottom wall 13A of the first chamber 8 is separated into two parts 13A-1, 13A-2, which are connected to the two plates of the centre portion 12A separately. Due to the existence of the narrow slit 19, the bottom wall 13A does not extend between the first and second face walls 4, 5 as does the bottom wall 13 of FIG. 3. The upper wall 14A of the second chamber 9 has a similar configuration to the bottom wall 13A. As shown in FIG. 5, the reinforcing structure 7A essentially defines two concave surfaces, each extending inwardly from a respective one of the first and second face walls 4, 5. Each of the concave surfaces comprises a part (13A-1 or 13A-2) of the bottom wall 13A, a plate of the centre portion 12A and a part (14A-1 or 14A-2) of the upper wall 14A. The concave surfaces can enhance the structural strength of the face walls 4, 5 against tension forces applied thereto. The narrow slit 19 defined in the centre portion 12A of the reinforcing structure 7A is used to limit the separation between the face walls 4, 5 when compression forces are applied thereto.

As shown in FIGS. 2 and 4, the portion 16 of the perimeter wall 6 forms a part of the walls of the fluid communication path 11 and the portion 18 of the perimeter wall 6 forms a part of the walls of the fluid communication path 10. That is, each of the fluid communication paths 10, 11 is arranged immediately adjacent to the perimeter walls 6. This arrangement is advantageous for ensuring the fluid communication between the first and second chambers 8, 9, and is particularly useful if the cartridge 1 is an air-sealed cartridge. An air-sealed cartridge prevents outside air from entering the internal space of the reservoir 2, and liquid is withdrawn from the reservoir 2 by connecting the outlet 3 to a pump generating a pressure lower than an internal pressure of the reservoir 2. Therefore, as liquid is withdrawn, the reservoir 2 deforms so as to have a decreasing internal volume. In this process, peripheral portions of the reservoir 2 generally tend to deform less than the mid-portions of the reservoir. In particular, as discussed above, the perimeter walls 6 act to reinforce the portions of the reservoir 2 which are immediately adjacent to the perimeter walls 6. Further, the reservoir 2 may have a rigid framework formed around the boundaries of the face walls 4, 5. Such a rigid framework further reinforces the peripheral portions of the reservoir 2. Therefore, as the fluid communication paths 10, 11 are located immediately adjacent to the perimeter walls 6, they are kept open, and allow fluid communication between the first and second chambers 8, 9, until at least a substantial portion of liquid has been withdrawn from the reservoir 2. This facilitates the process of dispensing liquid from the reservoir 2 and reduces the amount of liquid being trapped in the reservoir 2 due to the deformation of the reservoir 2, thereby reducing the amount of liquid that cannot be withdrawn.

It will be appreciated that the fluid communication paths 10, 11 may be modified such that the reinforcing structure 7 alone forms the walls of the fluid communication paths 10, 11. It will further be appreciated that such modified fluid communication paths 10, 11 may still be located relatively close to the boundary of the reservoir 2 as defined by the perimeter walls 6, in order to benefit from the structural reinforcement brought by the perimeter walls 6.

Further, as shown in FIGS. 2 and 3, each of the right-end portion 15 and the left-end portion 17 of the reinforcing structure 7 is recessed from a plane defined by each of the face walls 4, 5. This reduces the cross-sectional size of the fluid communication paths 10, 11. With the thickness of the walls of the paths 10, 11 remaining the same, the rigidity of the paths 10, 11 is increased with the cross-sectional size of the paths 10, 11 being reduced—the ratio between the thickness of the wall and the cross-sectional size being increased. The increased rigidity of the paths 10, 11 ensures that in the processing of dispensing liquid from the reservoir 2, the fluid communication paths 10, 11 will not collapse before the rest of the reservoir collapses. That is, by providing fluid communication paths 10, 11 having increased rigidity than the first and second chambers 8, 9, it is ensured that fluid will not become trapped in one of the chambers during use. Additionally, it will be understood that the recessed reinforcing structure 7 may allow the cartridge to be easily gripped by either a human or a machine.

Further, as shown in FIGS. 1, 2 and 3, a cross-sectional size of each fluid communication path 10, 11 increases from a mid-point between the first and second chambers 8, 9, where the cross-sectional size is at a minimum value, towards the first and second chambers 8, 9. This forms a funnel shape at each axial end of the fluid communication path and also smooths the corners at the interface between the chambers 8, 9 and the fluid communication paths 10, 11, thereby preventing liquid from being trapped at the corners. Further, this feature allows a continuous and smooth interface to be formed between the chambers 8, 9 and the fluid communication paths 10, 11, thereby relieving the stress at the interface.

A second embodiment of a cartridge 1' is schematically shown in FIGS. 6 to 10 and described in more detail below. Components of the second embodiment that correspond to those of the first embodiment are labelled using the same numerals as the first embodiment but with a prime symbol ' for differentiation. The features and advantages described above with reference to the first embodiment are generally applicable to the second embodiment.

As described above with reference to the cartridge 1, the cartridge 1' includes a reservoir 2' for storage of liquid and an outlet 3' for dispensing the liquid. The liquid stored in the reservoir 2' may, for example, include ink or solvent, or any other liquid suitable for use with an inkjet printer. The reservoir 2' includes a first face wall 4' (see FIG. 8), a second face wall 5' (see FIG. 8) and perimeter walls 6' (see FIG. 7). The second face wall 5' has a second boundary as shown in the emboldened dashed line (virtual) in FIG. 6. The first face wall 4' has a first boundary (not shown) which is of a similar shape to the second boundary of wall 5'. The perimeter walls 6' connect the respective boundaries of walls 4', 5'. The reservoir 2' is further provided with a reinforcing structure 7' to control a separation S' between the two face walls 4', 5'.

Figure 6:
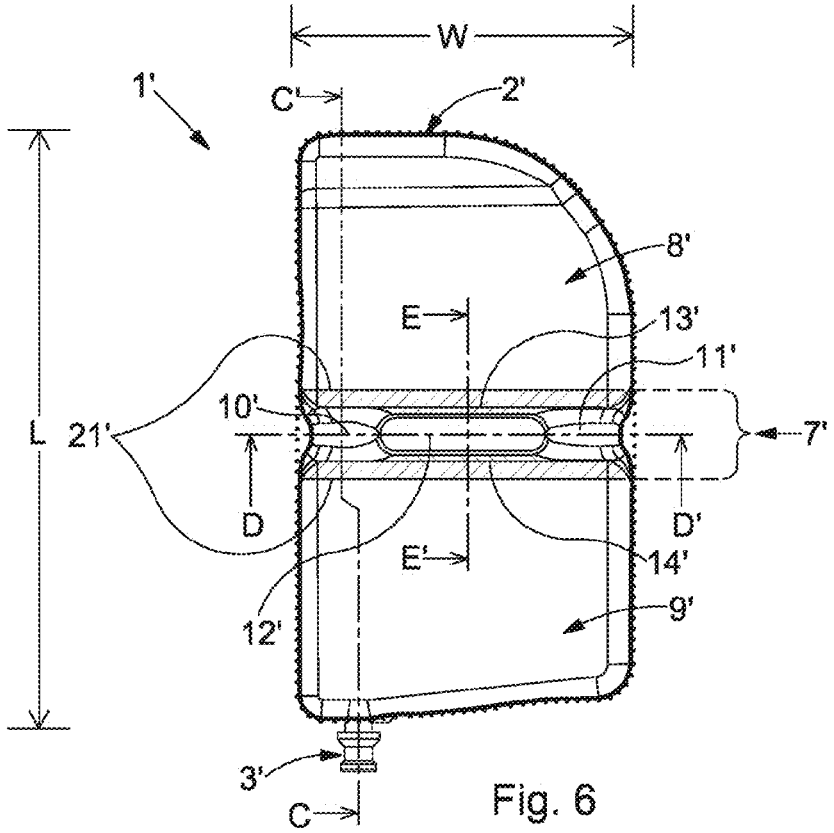
FIG. 6 is a front view of a cartridge according to a second embodiment of the present invention.
Figure 7:
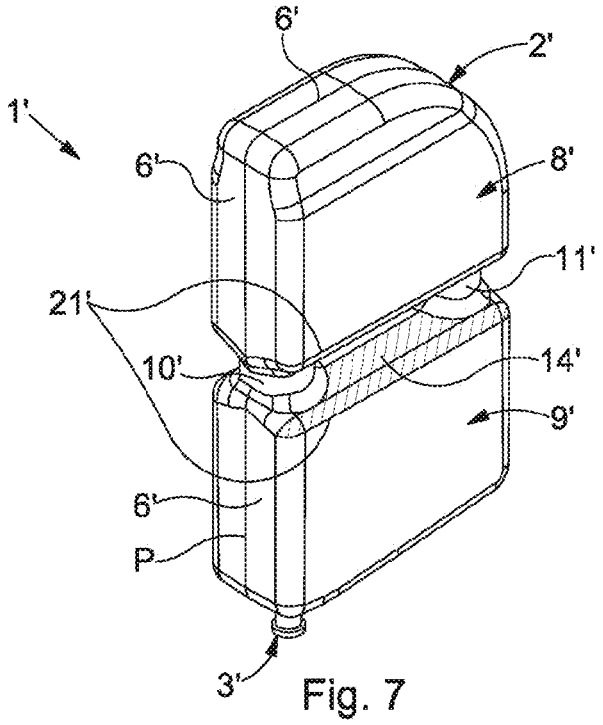
FIG. 7 is a perspective view of the cartridge shown in FIG. 6.
Figure 8:
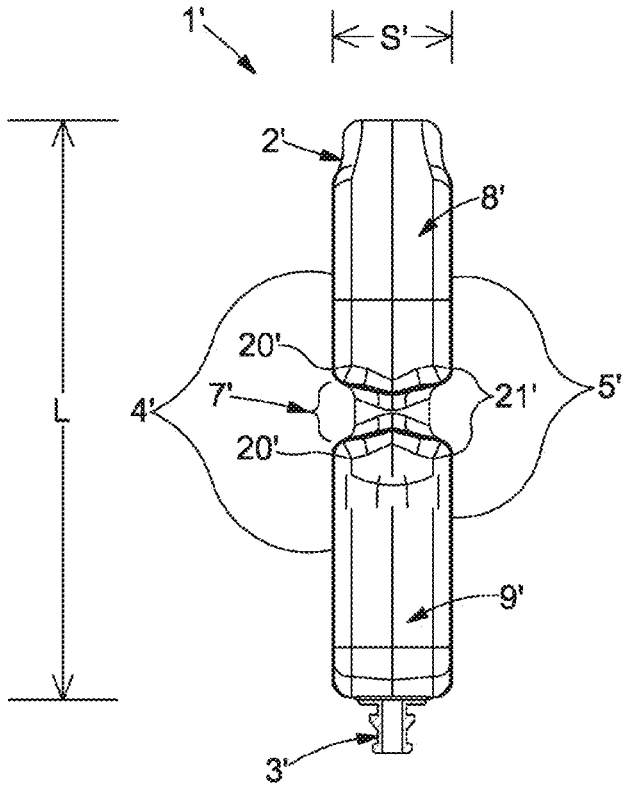
FIG. 8 is a cross-sectional side view of the cartridge shown in FIG. 6 when the cartridge is cut along line C-C'.
Figure 9:
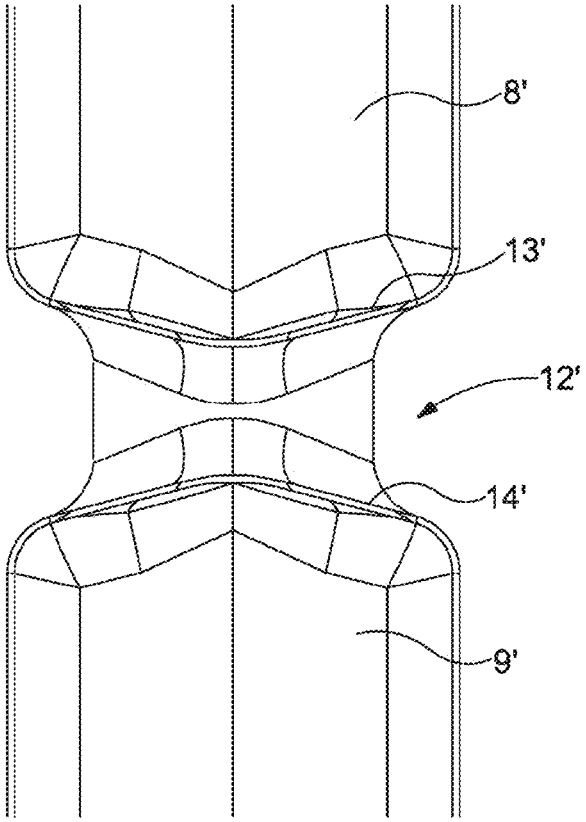
FIG. 9 is a cross-sectional side view of the cartridge shown in FIG. 6 when the cartridge is cut along line E-E'.

As shown in FIGS. 6, 7 and 8, the reinforcing structure 7' does not protrude beyond outer boundaries of the reservoir 2' as defined by the face walls 4', 5' and the perimeter walls 6'. As shown in FIGS. 6 to 8, the reinforcing structure 7' extends from a part 21' of the second face wall 5'. The part 21' is within the second boundary of the second face wall 5', as clearly shown in FIG. 6. In particular, the part 21' is surrounded by the second boundary and does not protrude beyond the second boundary. While the left and right end points of the part 21' may lie on the second boundary, all other portions of the part 21' are spaced apart from the second boundary. Likewise, the reinforcing structure 7' also extends from a part 20' of the first face wall 4' (see FIG. 8). The part 20' is within the first boundary of the first face wall 4'. The reinforcing structure 7' separates the internal space of the reservoir 2' into a first chamber 8' and a second chamber 9' (see FIGS. 6 to 8) and provides fluid communication paths 10', 11' between the chambers 8', 9' (see FIGS. 6, 7 and 10). The reinforcing structure 7' further defines a bottom wall 13' of the first chamber 8' and an upper wall 14' of the second chamber 9'. As shown in FIGS. 8 to 9, the bottom wall 13' and the upper wall 14' each extend between the first face wall 4' and the second face wall 5' of the reservoir 2'.

Figure 10:
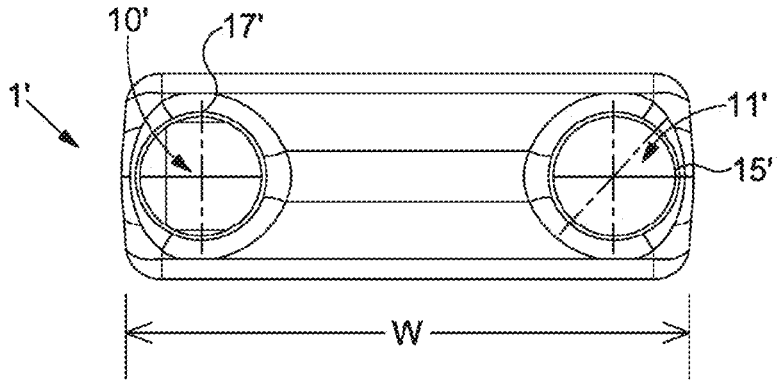
FIG. 10 is a cross-sectional view of the cartridge shown in FIG. 6 when the cartridge is cut along line D-D'.

However, the reinforcing structure 7' of the second embodiment is different from the reinforcing structure 7 of the first embodiment in that, as shown in FIGS. 7 and 10, the fluid communication paths 10', 11' are solely defined by a left-end portion 17' and a right-end portion 15' of the reinforcing structure 7', respectively, rather than also being defined by the perimeter walls 6'. Further, the left-end portion 17' and the right-end portion 15' of the reinforcing structure 7' are not only recessed from a plane defined by each of the face walls 4', 5' of the reservoir 2', but are also recessed from a plane defined by a respective perimeter wall 6'. A cross section of the fluid communication paths 10', 11' is substantially circular. Each of the fluid communication paths 10', 11' has a width in the third direction (i.e. the direction of the width W), which is substantially less than the width W of the reservoir 2'.

The reinforcing structure 7' of the second embodiment is further different from the reinforcing structure 7 of the first embodiment in that the reinforcing structure 7' has an aperture 12' surrounded by the bottom wall 13' of the first chamber 8', the upper wall 14' of the second chamber 9', the right side of the left-end portion 17' and the left side of the right-end portion 15'. As shown in FIG. 9, which is a cross-sectional side view of the reservoir 2' when the reservoir 2' is cut along line E-E' in FIG. 6, the bottom wall 13' and the upper wall 14' are not connected by any further elements except the left-end portion 17' and the right-end portion 15' of the reinforcing structure 7'.

As further shown in FIG. 9, the bottom wall 13' of the first chamber 8' has a smooth profile on which there are no abrupt changes. It has been found that stress concentrations are may appear around abrupt changes in a surface profile and that high stress concentration is a common cause of failure of mechanical parts. By arranging the bottom wall 13' to have a smooth profile, for example as illustrated in FIG. 9, stress is evenly distributed over a broader area, i.e., throughout the surface of the bottom wall 13'. Similarly, the upper wall 14' of the second chamber 9' also has a smooth profile to distribute stress. In this way, stress concentrations around the aperture 12' are greatly reduced and the cartridge 1' becomes more structurally durable. Therefore, by configuring each of the bottom wall 13' and the upper wall 14' to have a smooth profile, it is advantageous for allowing the cartridge to meet the respective regulation requirements for transportation of hazardous goods (which may, for example, require that a the cartridge can withstand a predetermined internal pressure). The bottom wall 13' may be referred to as a first portion of the wall of the reservoir 2'. The upper wall 14' may be referred to as a second portion of the wall of the reservoir 2'.

As shown in FIG. 6, the aperture 12' is formed substantially at the centre of the cartridge 1', surrounded by the first chamber 8', the second chamber 9', and the fluid communication paths 10', 11'. As further shown in FIGS. 6 to 8, the aperture 12' is directly accessible from the exterior of the cartridge 1', by for example hands of a human operator. The aperture 12' is completely isolated from the internal space of the cartridge 1', by walls (including, for example, the walls 13', 14', and walls of the portions 15' and 17') of the cartridge 1'. In particular, the aperture 12' is separate from each of the fluid communication paths 10', 11'. The separation between the aperture 12' and the fluid communication paths 10', 11' is achieved by the left-end portion 17' and the right-end portion 15' of the reinforcing structure 7'. As described above, the left-end portion 17' and the right-end portion 15' comprise walls defining the fluid communication paths 10', 11', respectively. In this way, the aperture 12' is isolated from any liquid stored in the reservoir 2' when the cartridge 1' is in use.

As further shown in FIG. 9, the aperture 12' forms a through-hole within the cartridge 1'. The aperture 12' extends from the face wall 4' to the face wall 5' of the reservoir 2'. That is, the aperture 12' extends through the cartridge 1' entirely.

The cartridge 1' is relatively easy to manufacture with the existence of the aperture 12', especially when the cartridge 1' is made by rotational or blow moulding. In particular, a mould for manufacturing the cartridge 1' may include two halves that are of similar shapes to each other. Centre portions of the two halves will directly contact each other and moulding material thus will not flow in between the centre portions of the two halves, thereby resulting in the aperture 12' being formed in the centre of the formed cartridge 1'. In this way, moulding material is only required to be formed on the inner surfaces of the two halves mould and is not required to flow into any narrow space provided between two halves of the mould. This reduces the manufacturing complexity of the cartridge 1' when compared to the cartridge 1 described with reference to FIGS. 1 to 4. It is further envisioned that the aperture 12' may be advantageous for enhancing structural robustness of the reservoir 2'. For example, the aperture 12' serves to accommodate the expansion of surrounding structures when exposed to temperature fluctuations, thereby alleviating the thermal stress generated within the reinforcing structure 7' during thermal expansion processes.

It is further noted that in the reservoir 2', the bottom wall 13' and the upper wall 14' act as links between the first and second walls 4', 5', and serve to reinforce the face walls 4', 5' against compression and tension forces applied thereto, thereby maintaining the separation S' between the two face walls 4', 5' between predetermined limits. In particular, the bottom wall 13' and the upper wall 14' each directly restrict the expansion of the separation S' and effectively prevent the separation S' from exceeding a predetermined upper limit. Therefore, the extent of distortion or deformation, such as bulging or ballooning, experienced by the reservoir 2' when filled with a high volume of liquid is reduced. Further, the bottom wall 13' and the upper wall 14' also provide resistance against compression applied to the face walls 4', 5', thereby preventing the separation S' from falling below a predetermined lower limit.

As discussed above, the cartridges 1, 1' are particularly well adapted to accommodate a high volume of liquid. The total volume of the cartridge 1 or 1' is at least 1000 millilitres. However, it will of course be appreciated that other cartridge volumes may be used. For example, a total volume of the cartridge 1 or 1' may be at least 500 millilitres, 600 millilitres, 700 millilitres, 750 millilitres, 800 millilitres, or 900 millilitres.

It is noted that whereas a cartridge having a volume of around 500 millilitres may have sufficient structural rigidity by virtue of its construction and relative small size, to avoid the need for further reinforcement, a cartridge which has a larger total volume may suffer from significant distortion when filled with liquid. This problem may become particularly apparent when cartridge volumes of around 1000 millilitres or greater are used. Therefore, it will be appreciated that the invention may be most beneficially applied to cartridges having relatively large volumes.

It will be appreciated that the perimeter walls 6, 6' of the first and second embodiments may be partially or completely omitted, such that at least a part of the face walls 4, 5 or 4', 5' are directly joined with each other at their respective boundaries, resulting in a pouch-shaped reservoir.

It will further be appreciated that the reinforcing structures 7, 7' may provide other numbers of fluid communication paths between the chambers 8, 9 or 8', 9' (e.g. one, three, or more). The location of the fluid communication path(s) along the width W of the reservoir 2 or 2' may be suitably varied. The cross-sectional shape of each fluid communication path may also be suitably varied.

It will also be appreciated that the reservoir 2 or 2' may comprise a plurality of the reinforcing structures 7 or 7'. The reinforcing structures may be spaced apart along the length L of the reservoir, and may separate the internal space of the reservoir into more than two chambers. For example, if the reservoir 2 or 2' comprises N reinforcing structures 7 or 7', the total number of chambers formed in the internal space of the reservoir may be N+1.

It will be appreciated that the reinforcing structures 7, 7' are particularly well adapted for an air-sealed cartridge containing volatile organic solvents, as the internal vapour pressure of the cartridge will increase due to evaporation of the solvents under high temperature storage or operation conditions. That is, air-sealed cartridges tend to suffer more severe deformation (as explained in detailed above) than cartridges in which the pressure is allowed to equalise with the external environment. However, it will of course be appreciated that the cartridges 1, 1' may also include a venting hole which is located, for example, in a top portion of the first chamber 8 as shown in FIG. 1 and in a top portion of the first chamber 8' as shown in FIG. 6. Such a venting hole may vent out the evaporated solvent and/or allow air to enter the reservoir as liquid is dispensed from the outlet. Thus the internal pressure within the reservoir may be maintained in equilibrium with the ambient pressure. The reinforcing structure 7, 7' is still helpful for enhancing the strength of the cartridge, and reducing any deformation caused by weight and fluidity of the liquid contained therein.

The cartridges 1, 1' may be formed from a thermoplastic material, suitably by rotational moulding or blow moulding. The thermoplastic material may, for example, be high density polyethylene resin or polypropylene.

Such thermoplastic material may be considered to have a degree of porosity. Thus, to prevent solvents from migrating through the moulded thermoplastic material via the pores thereof, a barrier layer may be applied at the internal surface of the cartridge 1, 1' during the manufacturing process. Such barrier layer may be arranged to block, or at least reduce the extent of, solvent migration. Alternatively, suitable chemical additives may be added to the thermal plastic material during the moulding process to close the pores of the thermoplastic material.

It will be appreciated that by rotational moulding or blow moulding, the body of the cartridge 1, 1', including the reservoir 2, 2' and the outlet 3, 3', can be formed at the same time as a single-piece item.

It is preferable to ensure that a moulded parting line P (see FIGS. 2 and 7), which lies in the centre line of the perimeter walls 6 or 6' and extends around the reservoir 2 or 2', is of robust quality. This will ensure that two halves of the cartridge 1 or 1', which were joined by the moulded parting line P during manufacturing, do not easily part from each other when the cartridge 1 or 1' is filled with a high volume of liquid or during handling. For example, where a single fluid communication path is provided, the reservoir may be considered to have a narrow "waist" region which forms the fluid communication path. On the other hand, where more than one fluid communication path is provided, the reservoir may be considered to have a plurality or narrowed waist-like regions, one corresponding to each fluid communication path.

It will be understood that while an aperture 12' is provided in some embodiments, where a single fluid communication path is provided (which may, for example, take the form of either one of the fluid communication paths 10', 11' as shown in FIG. 6), no aperture will be formed on the basis that only one side of the aperture 12' would be enclosed by a fluid communication path. However, the advantages associated with the omission of a centre portion 12 being in the form of a solid sheet can still be realised. That is, the absence of the solid centre portion 12 allows the walls defining the aperture 12' (or simply walls defining the reinforcing structure, where no aperture 12' is defined) to define a smooth profile, thereby reducing stress concentrations, as described in more detail above.

The cartridges as described herein may be used in an inkjet printer, such as a continuous inkjet printer. The inkjet printer may include a cartridge connection comprising a fluid connector for releasable engagement with the outlet of the cartridge. The cartridge connection may also comprise an electrical contact arranged to read information from and/or write information to an electronic data storage device associated with the cartridge.

Figure 11:
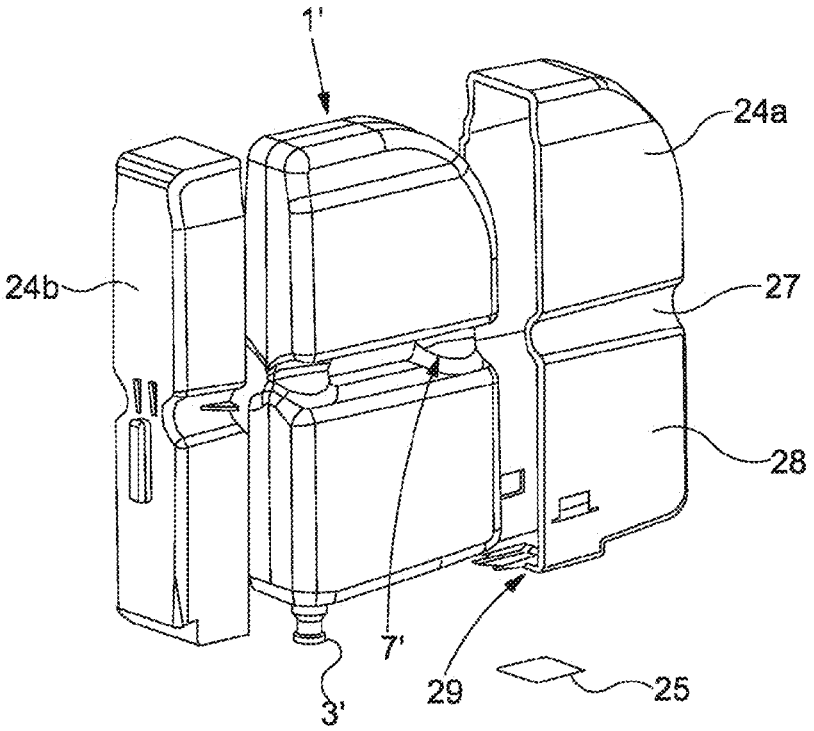
FIG. 11 is an exploded perspective view showing a shell casing and an electronic data storage device for use with cartridges shown in FIGS. 1 to 10.
Figure 12:
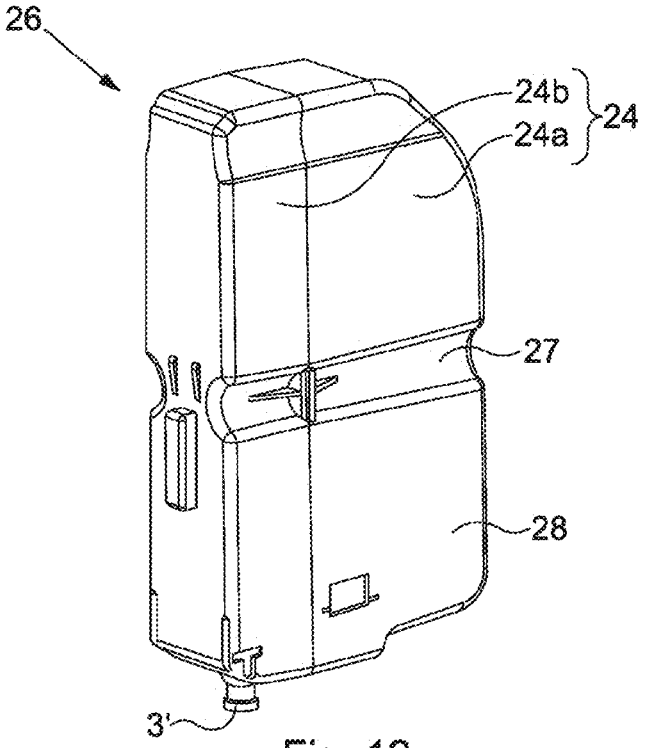
FIG. 12 is a perspective view of a cartridge assembly.
Figure 13:
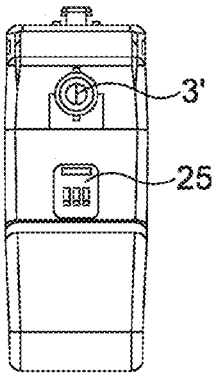
FIG. 13 is a bottom-view of the cartridge assembly shown in FIG. 12.

Each of the cartridges 1, 1' may be enclosed within a shell casing 24 so as to form a cartridge assembly 26. The shell casing is an example of a housing for a cartridge. As shown in FIGS. 11 and 12 in combination with the cartridge 1', the shell casing 24 includes two parts 24*a*, 24*b* which may be releasably joined together by snap fits or other suitable means. The cartridge assembly 26 may be provided with an electronic data storage device 25.

The shell casing 24 has a generally similar shape to that of the cartridge contained therein, for example, the cartridge 1' as illustrated in FIG. 11. In particular, the shell casing 24 has recessed grooves 27 formed in face walls 28 (which correspond generally to face walls 4', 5' of the cartridge 1'). The recessed grooves 27 have a generally similar shape to the corresponding recessed portions formed in the reinforcing structure 7' of the cartridge 1'. In this way, the shell casing 24 may provide additional structural support to the cartridge 1', especially to the reinforcing structure 7'. Therefore, the shell casing may be helpful to limit the extent of distortion or deformation, such as bulging or ballooning, experienced by the reservoir 1'. Additionally, the recessed grooves 27 may allow the cartridge assembly 26 to be easily gripped by either a human or a machine.

The shell casing 24 further has a card slot 29 for releasably receiving the electronic data storage device 25. The device 25 may, for example, store data identifying the cartridge 1', data identifying the type and characteristics of liquid contained in the cartridge 1', or other suitable data. By mounting the device 25 to the shell casing 24, a certain degree of deformation of the cartridge 1' within the shell casing 24 can be experienced without affecting the electronic contact between the device 25 and a corresponding electrical contact of the inkjet printer. Alternatively, electronic data storage device 25 may be received within a slot (or other suitable location) provided by the cartridge 1' itself. Of course, it will be appreciated that the electronic data storage device 25 may be mounted on or within the cartridge assembly in any convenient way, or even omitted entirely.

The shell casing 24 is arranged to substantially enclose the cartridge 1' when the two parts 24*a*, 24*b* of the shell casing 24 are joined with each other. However, as shown in FIG. 12, the shell casing 24 does not cover the outlet 3' of the cartridge 1' allowing the outlet 3' of the cartridge 1' to engage with the a suitably configured fluid connector of the ink supply system portion of a printer. Of course, alternative arrangements may also be provided in which a different number of parts form the shell casing, and in which the cartridge is configured to be in fluid communication with the ink supply system portion of a printer.

The outlet 3' of the cartridge 1' and the storage device 25 are both positioned on the same side, for example, the bottom side, of the cartridge assembly 26. In use, the cartridge assembly 26 may be installed to an inkjet printer, by connecting the outlet 3' to a fluid connector of the inkjet printer and connecting the storage device 25 to an electrical contact of the inkjet printer. In alternative arrangements, the outlet and storage device (where present) may be arranged on different sides of the cartridge assembly, such as, for example, adjacent sides.

The shell casing 24 may be reusable. For example, after the cartridge 1' has been emptied, the cartridge assembly 26 may be disassembled and the shell casing 24 may be re-assembled around a new cartridge. The storage device 25 may be re-configured to store data identifying properties of the new cartridge, or may be replaced with a new storage device.

Of course, it will be appreciated that a shell casing may be provided which has a shape which is different from that described above, and which is also substantially different from that of a cartridge contained therein. For example, in some embodiments a shell casing may have an outer shape which does not include the recessed groves 27. In such an embodiment an internal structure provided within the shell casing may provide additional structural support to the cartridge (e.g. an internal structure which protrudes into the recessed portions of the reinforcing structure 7'). Alternatively, or in addition, the external shape of the shell casing may be provided with features for engagement with a printer into which the cartridge is to be installed, or for ease of storage, transport or handling.

More generally, it will be understood that the shell casing 24, where present, provides a degree of rigidity and support to the cartridge assembly, reducing the extent to which the reservoir 1' is subjected to externally applied forces.

In some embodiments the reinforcing structure may be a sheet-like linkage structure entirely enclosed by the internal space of the reservoir. In particular, the linkage structure may extend between the inner surfaces of the face walls 4, 5 or 4', 5' without being exposed to the exterior environment. Apertures may be suitably formed, either through the linkage structure itself or beyond the boundaries of the linkage structure, to allow fluid communication between the two sides of the linkage structure. In this way, the linkage structure directly restricts the separation between the two face walls and effectively prevents the separation from exceeding a predetermined upper limit.

In further embodiments, the reinforcing structure may be in the form of a clip disposed at the exterior of the reservoir. Such a clip may comprise two end portions biased towards each other by a spring or the like. Each of the two end portions may extend outwardly from a mid-part of the respective first or second face wall of the reservoir. The biasing force provided by the clip to the two end portions serves to restrict the separation between the two face walls, thereby preventing the separation from exceeding a predetermined upper limit.

As still a further example, the reinforcing structure may comprise any convenient structure which enhances the strength and rigidity of the reservoir. For example, the reinforcing structure may comprise one or more recessed grooves, one or more protruding ridges, or one or more regions of honeycomb structure or the like which is formed on one or each of the face walls of the reservoir. Such a reinforcing structure may extend from a part of a face wall which is within a boundary of the face wall, in an inward or outward direction. These structures effectively enhance the strength of the face wall(s), thereby making them less susceptible to deformation. In this way, the tendency of the reservoir to bulge when filled with liquid is reduced. Separation between the face walls is thereby restricted from exceeding a predetermined upper limit.

As a further example, the reservoir of the cartridge may be formed with a single flexible sheet. For this type of cartridge, it will be appreciated that the reinforcing structure may take the form of at least one tether entirely enclosed by the internal space of the reservoir. The tether may connect two parts of the flexible sheet. The two parts may be located at opposite sides of the reservoir across the internal space of the reservoir. The tether may extend between the two parts through the internal space. In this way, the length of the tether will restrict the separation between the two parts of the reservoir and prevent the separation from exceeding a predetermined upper limit. Therefore, the extent of distortion or deformation, such as bulging or ballooning, experienced by the reservoir when filled with a high volume of liquid is reduced. It will also be appreciated from the above discussion that the reinforcing structure may be a clip disposed at the exterior of the reservoir. The clip comprises two end portions biased towards each other. The two end portions may connect to a respective one of the two parts of the flexible sheet. The biasing force provided by the clip to the two end portions maintains a predetermined separation between the two parts.

It will, of course, be appreciated that where terms such as "left", "right", "upper", and "lower" have been used to refer to portions of a reservoir (e.g. left-end portion 17) this is not intended to have any particular significance or imply any limitation. These terms are simply used for ease of reference to refer to the particular orientation which is illustrated in the figures.

It will further be appreciated that while several embodiments have been described above features described in combination with one embodiment may be combined with features of another embodiment as appropriate, even where not explicitly described.

While various embodiments have been described above it will be appreciated that these embodiments are for all purposes exemplary, not limiting. Various modifications can be made to the described embodiments without departing from the spirit and scope of the present invention.

The invention claimed is:

1. A cartridge for storing and dispensing liquid for use with an inkjet printer, the cartridge comprising:

a reservoir comprising at least one wall enclosing an internal space for storage of the liquid; and an outlet for dispensing the liquid;

wherein the reservoir comprises a reinforcing structure extending from a first part of the at least one wall and from a second part of the at least one wall;

wherein the reinforcing structure is adapted to:

maintain a predetermined separation in a first direction between the first and second parts of the at least one wall, the first and second parts of the at least one wall being within a boundary of the at least one wall;

separate the internal space of the reservoir into a first chamber and a second chamber, the reinforcing structure and the first and second chambers being arranged along a second direction perpendicular to the first direction; and provide at least one fluid communication path between the first and second chambers;

wherein the reinforcing structure comprises first and second portions of a reinforcing structure wall, the first and second portions partially defining the first and second chambers, respectively, and the reinforcing structure wall partially defining the at least one fluid communication path, the first and second portions of the reinforcing structure wall each defining an arcuate profile;

wherein the first and second chambers comprise respective first and second widths in a third direction perpendicular to each of said first and second directions, and said at least one fluid communication path comprises a third width, in said third direction, said third width being less than said first or second widths; and wherein the reservoir defines a flow circuit originating in the first chamber, then leading through the reinforcing structure via the at least one fluid communication path, then leading through the second chamber, and then leading to the outlet.

2. A cartridge according to claim 1, wherein the at least one wall comprises first and second opposed face walls, the first face wall comprising a first boundary defined by its perimeter, and the second face wall comprising a second boundary defined by its perimeter.

3. A cartridge according to claim 2, wherein the first part is comprised in the first face wall and the second part is comprised in the second face wall, and wherein the first part is within the first boundary and the second part is within the second boundary.

4. A cartridge according to claim 2, wherein the reinforcing structure is adapted to maintain a separation between the first face wall and second face wall below a predetermined upper limit.

5. A cartridge according to claim 2, wherein the reservoir further comprises one or more perimeter walls connecting the respective boundaries of the first and second face walls so as to define said internal space.

6. A cartridge according to claim 5, wherein the at least one fluid communication path is partially defined by a portion of the one or more perimeter walls.

7. A cartridge according to claim 2, wherein the reinforcing structure wall partially defining the at least one fluid communication path is recessed from a plane defined by the first or second face wall.

8. A cartridge according to claim 1, wherein the reinforcing structure is adapted to maintain a separation between the first and second parts below a predetermined upper limit.

9. A cartridge according to claim 8, wherein the reinforcing structure is adapted to maintain the separation between the first and second parts above a predetermined lower limit.

10. A cartridge according to claim 1, wherein the reinforcing structure is separate from the at least one wall.

11. A cartridge according to claim 1, wherein the reinforcing structure comprises an aperture at least partially surrounded by said first and second portions of the reinforcing structure wall partially defining the first and second chambers and said reinforcing structure wall partially defining the at least one fluid communication path.

12. A cartridge according to claim 11, comprising first and second fluid communication paths, wherein the aperture is surrounded by said first and second portions of the reinforcing structure wall partially defining the first and second chambers, and the reinforcing structure walls partially defining each of said first and second fluid communication paths.

13. A cartridge according to claim 1, wherein the cartridge is adapted to prevent air from entering the internal space of the reservoir from outside of the cartridge as the liquid is dispensed from the outlet.

14. A cartridge according to claim 1, wherein the cartridge is for use with a continuous inkjet printer.

15. A cartridge according to claim 1, wherein the reservoir is a single-piece item formed by blow moulding.

16. An inkjet printer comprising a cartridge according to claim 1.

17. An inkjet printer according to claim 16, wherein the inkjet printer is a continuous inkjet printer.

18. A cartridge assembly for use with an inkjet printer, comprising:

a cartridge according to claim 1; and a housing for the cartridge.

19. A cartridge assembly according to claim 18 further comprising an electronic data storage device configured to store data identifying the cartridge and/or the liquid contained in the cartridge.

20. A cartridge assembly, comprising:

a cartridge according to claim 1; and an electronic data storage device containing data relating to at least one of: a type of the liquid contained within the cartridge; and characteristics of the liquid contained within the cartridge.

21. A cartridge assembly, comprising:

a cartridge according to claim 1;

a housing configured to enclose the cartridge therein; and an electronic data storage device containing data relating to at least one of the cartridge and the liquid contained within the cartridge, wherein the electronic data storage device is at least one of: reconfigurable to store data identifying properties of a second cartridge that takes the place of the cartridge in the housing; removable from the housing; and configured to be read-from and written-to via an ink supply system of an inkjet printer.

22. A cartridge assembly, comprising:

a cartridge according to claim 1; and an electronic data storage device configured to store data identifying at least one of the cartridge and the liquid contained in the cartridge.

23. A cartridge for storing and dispensing liquid for use with an inkjet printer, the cartridge comprising:

a wall enclosing a reservoir; and an outlet;

wherein the reservoir comprises a first chamber, a second chamber, and a reinforcing structure between the first chamber and the second chamber;

wherein the reinforcing structure defines: a first fluid communication path between the first chamber and the second chamber; a second fluid communication path between the first chamber and the second chamber; and a center region between the first fluid communication path and the second fluid communication path;

wherein the center region provides a continuous load path from one side of the reservoir to another side of the reservoir when a pressure difference between the reservoir and a surrounding atmosphere exceeds a negative pressure difference threshold; and wherein the reservoir defines a first flow circuit originating in the first chamber, then leading through the reinforcing structure via the first fluid communication path, then leading through the second chamber, and then leading to the outlet.

24. The cartridge according to claim 23, wherein the center region does not provide the continuous load path therethrough when the pressure difference does not exceed the negative pressure difference threshold.

25. The cartridge according to claim 23, wherein the center region always provides the continuous load path therethrough.

26. The cartridge according to claim 23, wherein the reservoir defines a second flow circuit originating in the first chamber, then leading through the reinforcing structure via the second fluid communication path, then leading through the second chamber, and then leading to the outlet.

27. The cartridge according to claim 23, wherein the first fluid communication path and the second fluid communication path are parallel to each other.

* * * * *